US006096961A

United States Patent [19]

Bruti et al.

[11] Patent Number: 6,096,961

[45] Date of Patent: Aug. 1, 2000

[54] METHOD AND ELECTRONIC APPARATUS FOR CLASSIFYING AND AUTOMATICALLY RECALLING STORED MUSICAL COMPOSITIONS USING A PERFORMED SEQUENCE OF NOTES

[75] Inventors: Luigi Bruti, Pedaso; Demetrio Cuccu', Fermo; Nicola Calo', S. Benedetto Del Tronto, all of Italy

[73] Assignee: Roland Europe S.p.A., Aquaviva Picena, Italy

[21] Appl. No.: 09/153,245

[22] Filed: Sep. 15, 1998

[30] Foreign Application Priority Data

Jan. 28, 1998 [IT] Italy ..... MI98A0158

[51] Int. Cl.[7] ..... G10H 1/40; G10H 7/00

[52] U.S. Cl. ..... 84/609; 84/610; 84/611; 84/645; 84/DIG. 12

[58] Field of Search ..... 84/609–614, 634–638, 84/645, DIG. 12; 434/307 A

[56] References Cited

U.S. PATENT DOCUMENTS 5,235,126 8/1993 Bruti et al. .
5,461,192 10/1995 Imaizumi .
5,495,072 2/1996 Kumagi .
5,495,073 2/1996 Fujishima et al. .
5,587,546 12/1996 Kato et al. ..... 84/609
5,670,730 9/1997 Grewe et al. ..... 84/609
5,679,913 10/1997 Bruti et al. .
5,693,902 12/1997 Hufford et al. ..... 84/609 X

*Primary Examiner*—Stanley J. Witkowski
*Attorney, Agent, or Firm*—Young & Thompson

[57] ABSTRACT

The electronic apparatus comprises a processing unit for classification and storage of a plurality of musical compositions, and a control device, such as a keyboard or MIDI connection, for performing of sequences of connoting musical events, to be stored and related to each single musical composition. The same control device may then be, used for performing of one or more sequences of searching musical events, in order to automatically find and subsequently read-out an associated musical composition from a storage memory of the CPU. For this purpose, the processing unit comprises program means for comparing a searching sequence with the connoting sequence of musical events, reading-out one or more of the stored musical compositions in the event of total or partial equivalence between the compared sequences of musical events. It is thus possible to search for and identify a specific musical composition in short periods of time from a plurality of stored musical compositions, by using a simple musical technique.

28 Claims, 9 Drawing Sheets

METHOD AND ELECTRONIC APPARATUS FOR CLASSIFYING AND AUTOMATICALLY RECALLING STORED MUSICAL COMPOSITIONS USING A PERFORMED SEQUENCE OF NOTES

BACKGROUND OF THE INVENTION

The present invention relates to a method and an electronic apparatus for classifying and automatically searching for stored musical compositions in which a musician performs musical phrase or sequence of connoting musical events, that is correlated to a specific musical composition or musical piece in an electronic library of pre-stored musical compositions.

STATE OF THE ART

Electronic musical instruments, in particular electronic musical keyboards designed to perform automatic accompaniment functions, as well as the playing of musical compositions, are well known from several prior patents, for example from U.S. Pat. No. 5,461,192, U.S. Pat. No. 5,495,073, U.S. Pat. No. 5,495,072 and U.S. Pat. No. 5,679,913.

U.S. Pat. No. 5,235,126 also discloses a chord detecting device in an automatic accompaniment-playing apparatus, wherein, by playing at the same time the notes of a possible chord, the apparatus, on the basis of the differences existing between the notes, may detect and recognize the type of chord independently of its key; this device, however, is unsuitable or in any case does not allow automatic searches for musical compositions to be performed, its functions being limited solely to suggesting an automatic method for recognizing a chord independently of the key.

Moreover, in electronic musical instruments provided with an automatic device searching musical compositions within a storage library, at present the following two classification techniques are used:

1) classification of the compositions by a progressive numbering system, both for identifying and for making easier the subsequent finding thereof;
2) classification by means of the title, the author and/or the musical genre of the various compositions, again for identifying and making easier the subsequent finding thereof.

In both cases the classification and search technique is exclusively of the numerical and/or letter-based, i.e. non-musical type, so that it requires a particular amount of effort and time by an operator who, case where a wide-ranging library of musical compositions is used, must keep a special note-book containing the various identification data of the compositions, said note-book having to be manually consulted and read every time in order to find the identification data of the composition to be searched for.

Moreover, the operator must have, either on the musical instrument or separately, a special alphanumeric control means to introduce the various data identifying the musical composition to be selected.

All this is somewhat inconvenient and requires a lot of time in order to search for and read-out the desired musical composition; this method also has many disadvantages in all those situations where an immediate or very rapid response is required, for example in the case where a musician has to search for and play a musical composition in front of an audience, or in the case where he has to read-out a specific composition from a vast library in which the search has to be performed.

OBJECTS OF THE INVENTION

The general object of the invention is therefore to provide a method and an electronic apparatus for classifying and automatically searching for musical compositions which, unlike that which is known hitherto, uses a technique of a strictly musical nature, both for classification and identification of all the musical compositions to be stored and for subsequent searching for the musical compositions to be selected, thus being more suited to the cultural background and musical knowledge of a musician than the currently used systems.

A further object of the present invention is to provide a method and an electronic apparatus, as defined above, which can be used universally since they are independent of any problems of a linguistic nature associated with the titles and/or the authors of the various musical compositions to be classified and searched for, or with the musical genre of the composition searched for.

Yet another object of the present invention is to provide a method and an electronic apparatus for classifying and automatically searching for musical compositions, using a musical technique, by means of which it is possible to employ, as a control and composition search means, the same musical keyboard used by the musician during a normal performance, without requiring any additional control means such as, for example, an additional alphanumeric keyboard, thus making the system easier and simpler to use.

BRIEF DESCRIPTION OF THE INVENTION

These and other objects and advantages may be achieved by means of a method and an electronic apparatus for classifying and automatically searching for stored musical compositions using a musical technique, according to the present invention.

According to a first aspect of the invention, it is possible to assign or designate in advance a sequence of connoting musical events for each single musical composition, which connoting sequence is stored in a permanent memory of an electronic control unit in a manner associated with or related to each respective pre-stored musical composition. It is therefore possible to find and read-out subsequently a musical composition by simply performing or playing again the same connoting sequence of musical events, or part thereof, via a suitable execution means, such as a musical keyboard or MIDI interface, which is compared with the connoting sequences already stored and related to each musical composition to be searched for.

According to this aspect of the present invention, it has therefore been possible to provide a method for classifying and automatically searching for stored musical compositions, using a musical technique, comprising the steps of:

orderly classifying and storing, in a permanent memory, data relating to a plurality of musical compositions;

assigning for each stored musical composition a sequence of connoting musical events identifying the composition itself;

storing, in a permanent memory, coded data for each connoting sequence of musical events in a manner related to each respective musical composition of said plurality of stored musical compositions;

providing a data processing and control unit programmed with algorithms for classifying and searching for data relating to said stored musical compositions, and to be related to the coded data of each connoting sequence of musical events;

searching for and automatically reading-out from said plurality of stored musical compositions, by said control and processing unit, the data relating to at least one musical composition by musically performing a sequence of searching musical events corresponding to at least a significant part of a connoting sequence by a musical event performing means, and by performing a comparison between the search sequence and the stored connoting sequences of musical events.

Still according to this first aspect of the present invention, it has therefore been possible to provide an electronic apparatus for classifying, storing and automatically searching for musical compositions, by a musical technique comprising:

means for classifying and storing data relating tc a plurality of musical compositions;

means for assigning a connoting sequence of musical events to each composition of said plurality of stored musical compositions;

means for storing coded data of a connoting sequence of musical events assigned in a related manner to each stored musical composition;

a data control and processing unit, said data control and processing unit being programmed with algorithms for classifying and searching for the stored data relating to the connoting sequences of musical events of the musical compositions;

as well as means for performing musical events, operatively connected to the data processing unit, to perform and store in the latter, coded data relating to connoting sequences of musical events related to each musical composition, or to perform search musical events and compare to the stored connoting sequences of musical events, in order to search for and automatically readout a required musical composition from said plurality of stored musical compositions by the comparison between said search musical events and said connoting sequence of musical events related to the musical composition.

According to another aspect of the invention, the search for a musical composition may be performed by simply executing a sequence of musical events belonging to a musical composition to be searched for, and by carrying out the search by a comparison between the sequence of musical events executed using an appropriate control means, and the corresponding sequence of musical events directly within the musical composition to be searched for.

In accordance with this second aspect of the invention, it has therefore been possible to provide a method for classifying and automatically searching for musical compositions, using a musical technique, comprising the steps of:

orderly classifying and storing, in a permanent memory, data relating to a plurality of musical compositions;

providing a data processing and control unit programmed with algorithms for classifying and searching for data relating to said plurality of stored musical compositions;

searching for and automatically reading-out from said plurality of stored musical compositions, by the aforementioned control and processing unit, the data relating to at least one musical composition by musically executing a significant search sequence for musical events belonging to the musical composition to be searched for, by a musical event executing means.

According to a further aspect of the invention it has been possible to provide an electronic apparatus for classifying and automatically searching for musical compositions, using a musical technique, comprising:

means for classifying and storing data relating to a plurality of musical compositions;

a data processing and control unit programmed with algorithms for classifying and searching for the stored data relating to said stored musical compositions;

as well as a means for performing search musical events belonging to a musical composition to be searched for in the said plurality of stored musical compositions, by the aforementioned processing and control unit.

According to yet another aspect of the present invention, it has been possible to provide an electronic musical instrument comprising sound generating means, and control means for performing sequences of musical events, the musical instrument comprising an electronic apparatus for classifying and automatically searching for the musical compositions by a musical technique, said electronic apparatus in turn comprising:

means for classifying and storing data relating to a plurality of musical compositions;

means for assigning connoting musical events related to each of said plurality of stored musical compositions;

means for storing coded data of a connoting sequence of musical events related to each stored musical composition;

a data processing unit, said data processing unit being programmed with algorithms for classifying and searching for data relating to the connoting event sequence of the musical compositions;

as well as means for performing musical events, operatively connected to the data processing unit, for performing and storing, in the latter, coded data relating to connoting sequence of musical events to be related to each musical composition or for executing search musical events to compare with the stored sequence of connoting musical events, to search for by said comparison and automatically read-out a musical composition from said plurality of stored musical compositions.

BRIEF DESCRIPTION OF THE DRAWINGS

These and other features of the method and the electronic apparatus for classifying and automatically searching for musical compositions, by a musical technique, according to the present invention, will be more clearly explained hereinbelow, with reference to the accompanying drawings, in which:

FIGS. 5 and 6 show in combination a flow chart illustrating the method for automatically searching for a musical composition, in the case where the sequence of musical events used for the search, should contain a number of events equal to or less than the connoting sequence of musical events of the musical composition searched for;

FIGS. 7 and 8 show in combination a flow chart illustrating the method for automatically searching for a musical composition in the case where the sequence of musical events used for the search should contain a number of events greater than the connoting sequence of musical events of the musical composition searched for;

DETAILED DESCRIPTION OF THE INVENTION

With reference to FIGS. 1 to 6, a preferred embodiment of an electronic apparatus and the method for classifying and searching for musical compositions, using a musical technique, according to the invention is first described.

Figure 1:
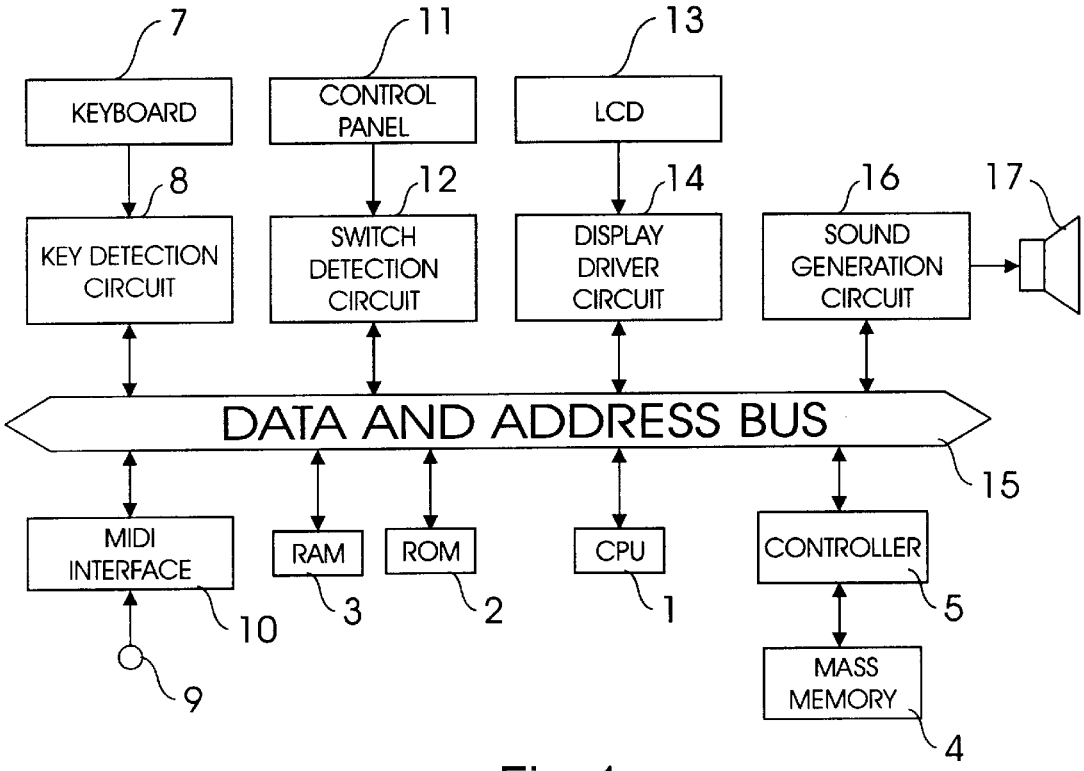
FIG. 1 is a block diagram showing an arrangement of an electronic apparatus according to a preferred embodiment of the present invention.

As shown in FIG. 1, the apparatus comprises various functional blocks connected by a data and address bus.

More precisely, the apparatus comprises a central data processing unit 1 (CPU) which controls the entire apparatus, a ROM memory 2 containing the working program of the CPU, as well as the algorithms for classifying and automatically searching for musical compositions using a musical technique according to the present invention, and a read-write memory 3, such as a RAM.

The block 4 in FIG. 1 indicates a mass memory, for example a hard disk or other type of permanent memory which is either inside or outside the apparatus and is intended to contain or store a plurality of musical compositions with the associated connoting "signatures" for identification thereof, as defined further below; inlet and outlet data control from the mass memory 4 is performed by a normal controller 5; the controller 5 also manages the transfer of data between the mass memory 4 and the working memory 3 (RAM) of the central processing unit 1.

The apparatus comprises, moreover, control means which can be actuated by an operator for performing of sequences of musical events, in particular connoting sequences of musical events or notes for identifying the individual musical compositions stored in the mass memory 4. In FIG. 1, these control means consist of a keyboard 7, for example a musical keyboard connected to the data bus 15 by a respective key detection circuit 8 for detecting the events entered by pressing a key. Instead of and/or in combination with the musical keyboard 7, any other suitable means for controlling and performing or generating connoting sequences of musical events may be provided, for example the inlet 9 of a MIDI interface 10, as shown.

The apparatus is completed by a control panel 11 with an associated switch detection circuit 12 for detecting the state of the various switches on the control panel, and also comprises an LCD visualizer 13 with associated display driver circuit 14 and a circuit 16 for sound generation which can be heard via one or more loudspeakers 17. The same sound generation function may be performed by a musical composition generator outside the apparatus and connected to the latter by the serial MIDI interface 10.

Figure 2:
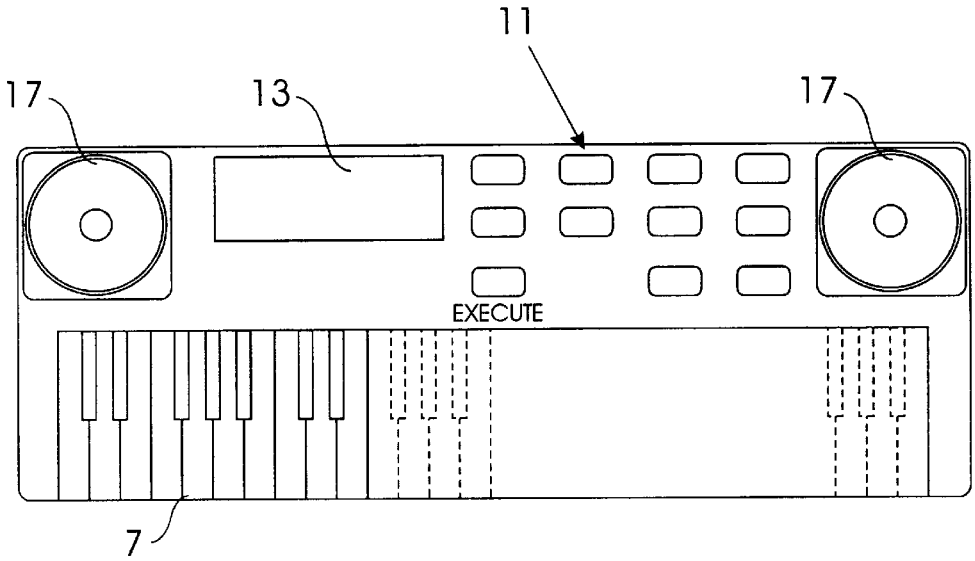
FIG. 2 is a front view showing the structure of an electronic musical apparatus provided with a control panel and a control keyboard of the musical type.

A conventional structure of an electronic apparatus according to the invention may for example be that shown schematically in FIG. 2 of the accompanying drawings, in which the same reference numbers have been used to indicate parts similar or equivalent to those shown in FIG. 1; in particular 7 denotes again the musical keyboard, 11 the control panel and associated keys, 13 the display, while 17 indicates again the loudspeakers connected to a sound generating circuit.

CLASSIFYING AND SEARCH METHOD

Still with reference to FIG. 1, the general features of the method for classifying and automatically searching for musical compositions according to the invention will now be described.

As previously mentioned, the electronic apparatus is used for classifying and automatically searching for musical compositions relating, for example, to songs and/or style accompaniments, which can be processed, listened to and/or differently used by an operator.

Therefore it is necessary to previously store in an ordered manner in the mass memory 4, data relating to a plurality of musical compositions or musical pieces to be classified and subsequently searched for; these data essentially consist of notes, key and rhythm of the actual musical composition and any data relating to the title, its author or any other information which can be displayed on or read from the display 13, and which is useful for connoting or identifying a musical composition to be searched and selected.

Following storage of the various musical compositions, a sequence of connoting musical events, such as for example a sequence of notes of the same composition already classified in the mass memory 4, is assigned for each composition, accordingly storing each connoting sequence in its own permanent memory, for example in a suitable zone of the mass memory 4 or in a separate memory, but in a manner related to a respective musical composition.

The assignment and the storage of the various connoting musical events of the musical compositions may be performed by the musical keyboard 7 or via the inlet 9 of the MIDI interface 10, or by using any other control means suitable for performing of sequences of musical notes or connoting musical events to be stored in a coded form.

For the purposes of the present description, the term connoting "musical event" is understood to mean any note event, for example the pitch of a note, its time, and the value differences between adjacent notes of the musical event to be stored, both in relative and absolute terms, or any other musical data relating to both the melodic and/or the accompaniment part, provided that it is suitable for identifying or distinguishing that specific composition.

Since the choice of the connoting musical events for the compositions may influence to a certain degree both the methods for selecting the compositions, and the speed for searching, it is necessary in each case to assign connoting musical events which are particularly suitable for the specific intended use.

According to a first preferred embodiment of the invention it has been agreed to use, as the connoting musical event of the compositions, the difference in pitch between one note and the preceding one in a sequence of musical notes, said difference being suitable for providing a connoting data for identifying a musical composition.

The original nature of this solution lies in that the identification and consequently the search for and selection of each musical composition may be performed irrespective of the beat or rhythm, the key or the contents of the musical composition itself to be identified and/or searched for, and in that the specific connoting events or sequence of connoting musical events may also be executed in an imperfect or incomplete manner. In fact, even if one or more musical events are omitted from the sequence of search events, or if unrelated events are added when searching for a musical a composition, the apparatus, on the basis of the programming algorithms, will in any case be able to search for and select the desired composition directly by the connoting events which have in common the sequence of the search events relating to several selected compositions.

The above will be clarified further below with reference to the flow charts of the accompanying drawings.

After storing the various musical compositions and after assigning and storing the various connoting musical events, relating them in an unambiguous manner to respective pre-stored musical compositions, by the same control means used for performing of the connoting musical events, for example the same musical keyboard of the electronic apparatus, it is possible now to carry out the automatic search for and the read-out of a desired musical composition by means of the data processing and control logic unit 1 which has been suitably programmed with algorithms for classifying and searching for the various data relating to the single musical compositions stored.

For this purpose, it is sufficient for the operator to perform musically, by means of the musical keyboard itself or any other suitable means for performing musical events, at least a significant part of a search sequence of musical events corresponding totally or partially to the connoting sequence of the musical events of the composition searched for. The data processing and control logic unit 1 will therefore automatically search, in the mass memory 4, for that specific composition, read-out it and transfer the same into the RAM, so that it can then be played or reprocessed, whereby other data and/or specific information relating to the read-out composition will appear at the same time on the display 13.

ENTRY OF MUSICAL EVENTS

Figure 3:
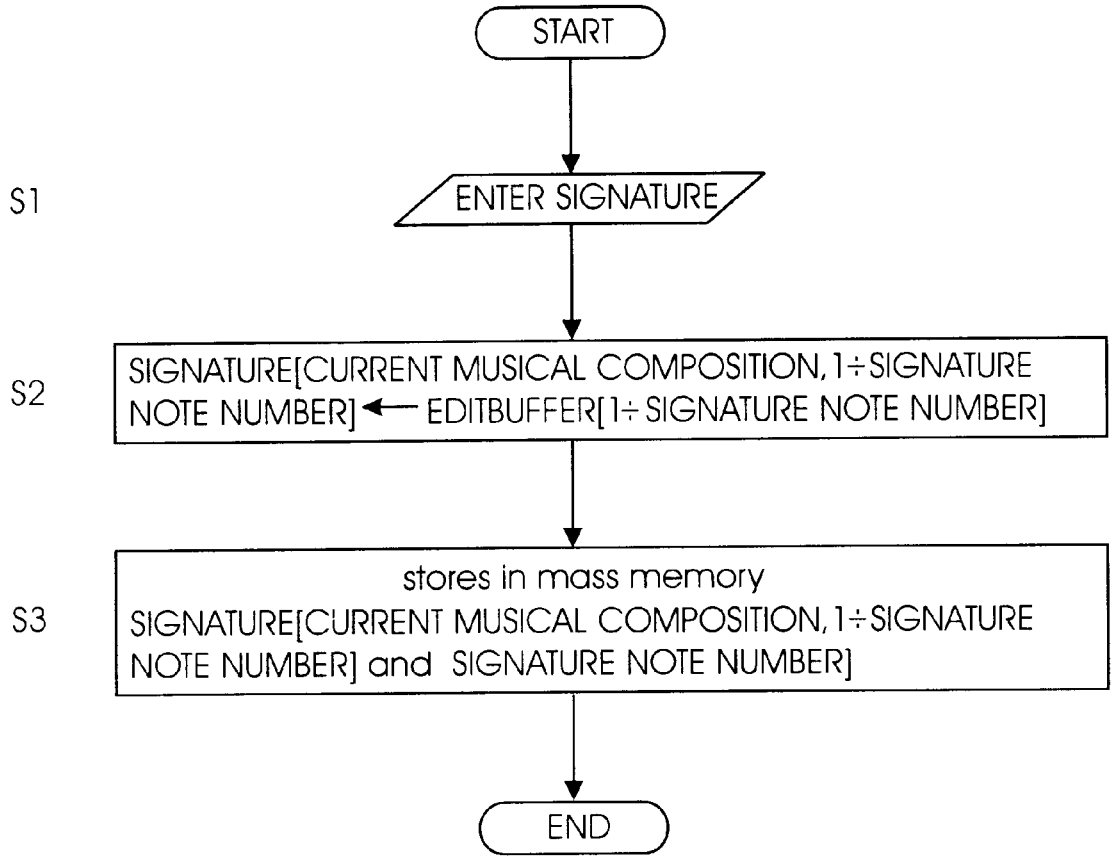
FIGS. 3 and 4 show two flow charts illustrating the method for entering and storing in a mass memory, sequences of musical events which are associated with the various musical compositions to be searched for and which form the connotations for identifying the compositions themselves.
Figure 4:
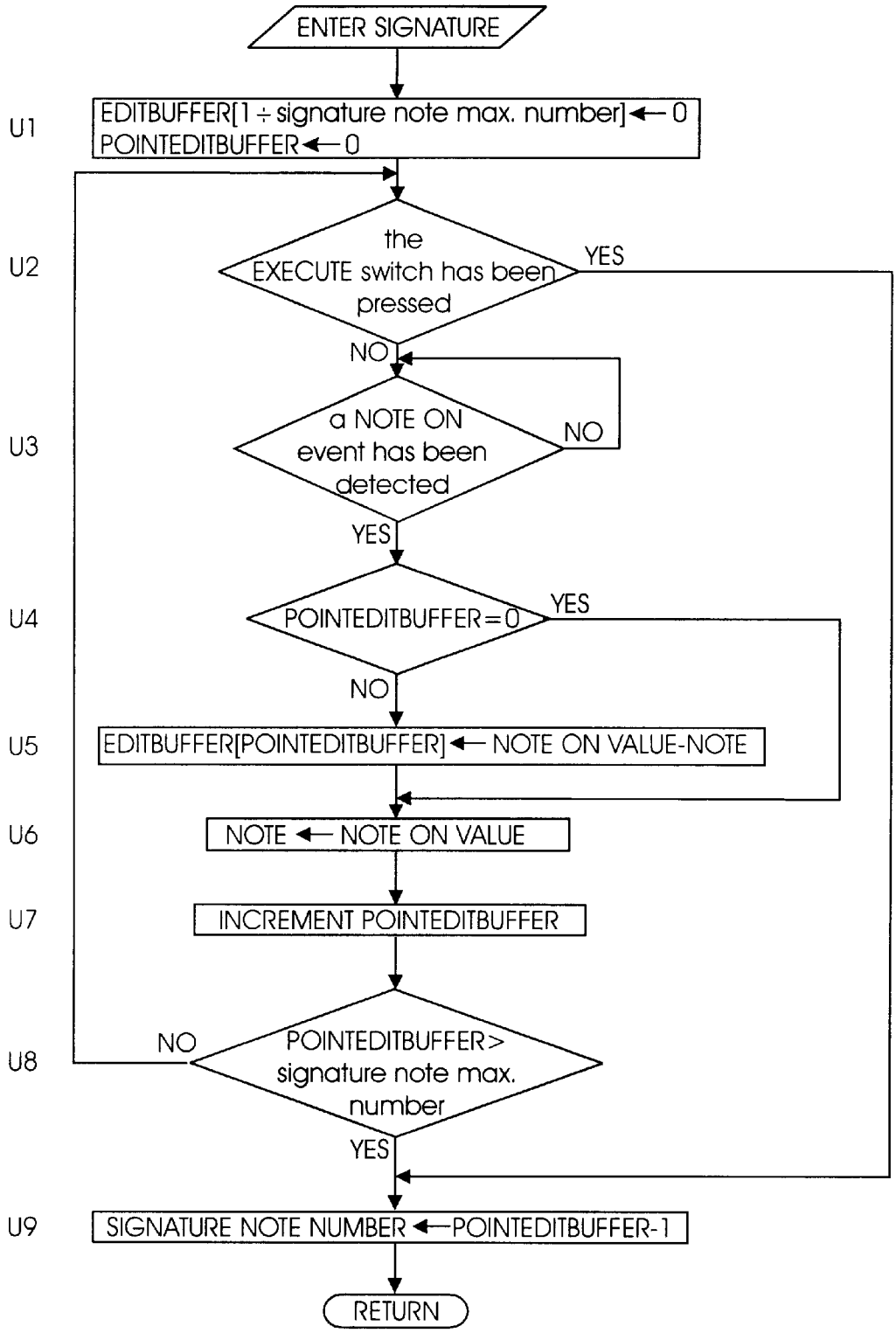

With reference to FIGS. 3 and 4, the entry and storage, in the mass memory 4, of the connoting sequences of musical events forming a "signature" to be related to a respective musical composition among a plurality of musical compositions contained in the same mass memory, will now be described.

While the execution of a sequence of musical events of the compositions is a necessary operation in order to search for and read-out a musical composition from the mass memory 4, the prior operation of assigning and storing the connoting musical events for the individual musical compositions although advisable is not altogether necessary since the search for one or more musical compositions, from a plurality of them, may be performed by means of a comparison, applied to the whole of the musical composition, of musical events or notes contained in the musical compositions themselves with the sequence of search events entered by the same user, as will be explained further below; however, the assignment and storage of a connoting sequence of musical events in the form of coded data related to each stored musical composition, is more advantageous since it allows the search to be speeded up greatly, limiting it to a search for the connotation or signature alone, instead of extending it to the entire musical composition.

The musical technique proposed according to the present invention for classifying and automatically searching for musical compositions, may therefore be correctly performed also in the absence of a specific pre-stored connotation or signature for each individual musical composition; however, in this case, as mentioned above, the comparison with the search musical events must be carried out on the whole composition for all the stored musical compositions, with correspondingly longer times. However, this alternative may be extremely advantageous, particularly in the case where the search for a musical composition must be carried out in large electronic libraries and for purposes other than those of immediately playing the composition searched for and selected.

According to a first preferred embodiment of the invention, during the entry of the connoting musical events, the musical notes which make up the connotation or the signature of the composition, are not stored in digital form as an absolute value, but as the relative difference between the pitches of one note and the immediately preceding one in the sequence of notes assigned to distinguish or connoting that composition, such that the next search step is independent of the beat and the musical key of the composition, and the actual signature used.

The difference is calculated by simply subtracting from the last musical note or pitch value produced by means of the keyboard 7, or the interface 10, the value or pitch of the directly preceding musical note.

The first note of each sequence of connoting musical events is therefore not used for calculation of the first difference, but assumed as having the value "zero".

The entry of the various musical notes or the various connoting events forming the signature of each specific composition, is therefore started and terminated by operating a suitable control switch on the control panel 11 of the apparatus or electronic musical instrument, for example the switch "EXECUTE", FIG. 2, or after the processing unit (CPU) of FIG. 1 has received information relating to the maximum allowed number of musical events from the keyboard 7 or the MIDI 10, to be stored into a memory.

For the purposes of this description, the "Note OFF" events when the key is released are omitted and only the "Note ON" events when the key is pressed are taken into consideration, without this having to be regarded as limiting for the present invention.

The storage, in a mass memory or in a specific memory, of the sequence of musical distinguishing events of the compositions may be performed only after execution or entry thereof, and essentially consists in recording the differences between the pitches of the abovementioned notes in a manner corresponding and relating to each specific preselected musical composition, by simply operating the pushbutton on the control panel 11 of FIG. 2.

A biunique relationship is therefore established between one sequence of musical notes or musical note events belonging to that composition which form the signature or connotation to be stored, and that particular current musical composition. In addition to the differences between notes, the number of musical notes or events forming the signature is also recorded, since said number could be less or greater than or in any case different from the maximum allowed number of notes, so as to speed up the subsequent search operation.

Although it is preferable to use the musical notes of the same musical composition, or rather a significant part of the composition, for example its melodic part, refrain, initial or ending part, or a specific accompaniment part, such as for example a drum phrase or the like, in order to connote and search for the composition, in certain cases it may be possible to perform a special sequence of connoting musical events which are different from those of the composition, for example a brief musical phrase, in order to identify the musical composition to be searched for. This may be useful in the case where a musician who is playing in front of an audience has to find rapidly a composition which is requested several times by the public, or for which it could be less convenient to assign a sequence of connoting musical events within the same composition.

DESCRIPTION OF THE FLOW CHARTS

Considering in detail the procedure for assigning and storing the sequences of connoting musical events, reference will be made to the flow charts in FIGS. 3 and 4 of the accompanying drawings; however, in order to facilitate reading thereof, the following nomenclature will be adopted:

EDIT BUFFER: set of memory locations containing the differences between the pitches of the musical notes forming the signature, just entered and to be stored in the mass memory 4, or to be searched for among the plurality of musical compositions pre-stored in the mass memory;

POINT EDIT BUFFER: indicates the currently selected memory location of EDIT BUFFER;

SIGNATURE NOTE NUMBER: number of differences between the pitches of the musical notes forming the connoting signature, after entry;

MAXIMUM SIGNATURE NOTE NUMBER: maximum allowed number of differences between the pitches of the musical notes forming the connoting signature;

CURRENT MUSICAL COMPOSITION: musical composition currently selected from the plurality of musical compositions in the mass memory, and to be stored and/or used for searching for the respective connoting signature;

SIGNATURE: sequence of connoting musical events of a musical composition or set of memory locations containing the differences between the pitches of the musical notes forming the connoting part of each musical composition pre-stored in the mass memory;

POINT SIGNATURE: indicates the SIGNATURE memory location, for a certain composition, from where the check as to equivalence with the first EDIT BUFFER memory location is to be started;

PS: indicates the currently selected SIGNATURE memory location, for a certain musical composition, the initial value of which is always POINT SIGNATURE;

NOTE-ON VALUE: number indicating the pitch of the last note played by the musician;

NOTE: value of the preceding NOTE-ON VALUE;

DISPLAY BUFFER: memory locations containing the names. of the musical compositions, whose connoting signature is the same as that entered, at the end of the search;

LCD LINE: indicates the number of the musical compositions, whose connoting signature is the same as that entered (contained in the EDIT BUFFER) and therefore to be displayed on an appropriate display, at the end of the search. During searching, however, it indicates the relative position, on the display, of the last musical composition found;

NUMBER OF AVAILABLE MUSICAL COMPOSITIONS: number of musical compositions pre-stored in the mass memory and forming the plurality of musical compositions available for searching;

NAME: set of locations in the mass memory containing the names of all the musical compositions pre-stored in the mass memory;

ADDRESS: set of locations in the mass memory containing the starting addresses of all the musical compositions pre-stored in the mass memory;

BUFFER ADDRESS: set of memory locations containing the starting addresses of the musical compositions, whose connoting signature is the same as that entered (contained in EDIT BUFFER), at the end of the search;

MUSICAL COMPOSITION NOTE: general musical note of the currently selected musical composition (CURRENT MUSICAL COMPOSITION) indicated by the pointer, POINT CURRENT MUSICAL COMPOSITION;

POINT CURRENT MUSICAL COMPOSITION: indicates the memory location of the currently selected MUSICAL COMPOSITION NOTE;

← (arrow): assignment symbol. The expression to the right of this symbol is assigned to the variable of the left-hand register.

At the start of the connoting procedure, after actuating the start switch of the procedure provided for on the appropriate control panel 11, the CPU performs the step S1 (ENTER SIGNATURE) for entry of the signature executed by the control means 7 or 9 for execution of the connoting musical events and initializes at the value zero (FIG. 4) the set of RAM memory locations which must contain the differences between the musical notes forming the connoting signature (U1—EDITBUFFER [1÷signature note maximum number]←0.

The CPU also initializes at the value zero an additional RAM memory location (U1—POINTEDITBUFFER←0) which indicates the position of the difference between the musical notes to be stored in the memory location set (referred to above EDIT BUFFER) (step U1) which at the end will produce the number of notes or more generally the number of musical connoting events which make up the signature.

The CPU, after verifying that the switch for the end of the signature note sequence has been actuated on the control panel 11 (step U2—the EXECUTE switch has been pressed) remains on standby for any ON/OFF note events (step U3—a NOTE ON event has been detected).

When a NOTE ON event has been detected, if it is not the first one (step U4—POINTEDITBUFFER=0) the CPU proceeds to calculate the difference between the pitch of this note and that of the preceding one, and then stores this difference in the RAM memory location (EDIT BUFFER) indicated by the value of the memory location relating to the position of the difference between the musical notes considered (POINT EDIT BUFFER) (step U5— EDITBUFFER [POINTEDITBUFFER]←NOTE ON VALUE−NOTE).

If it is not the first note, no difference is calculated and the step U5 is omitted.

At this point the value, or pitch, of the preceding note is updated with the value, or pitch, of the last note detected (step U6—NOTE←NOTE ON VALUE) and the value of the indication of the position of the difference between musical notes (POINTEDITBUFFER) is correspondingly incremented, for subsequent storage in the set of RAM memory locations of the signature (EDITBUFFER) (Step U7—INCREMENT POINTEDITBUFFER).

The steps U2, U3, U4, U5, U6, U7 and U8 are repeated for the same signature until it reaches the maximum allowed number of note differences (step U8) or until an end output command actuated by the appropriate switch "EXECUTE" (step U2) on the control panel, has been detected (step U8—POINTEDITBUFFER>signature note maximum number).

The last step U9 (SIGNATURE NOTE NUMBER←POINTEDITBUFFER−1) consists in calculating the number of differences entered as a simple decrease in the value of the indicator of the position of the difference between musical notes (POINTEDITBUFFER).

Figure 5:
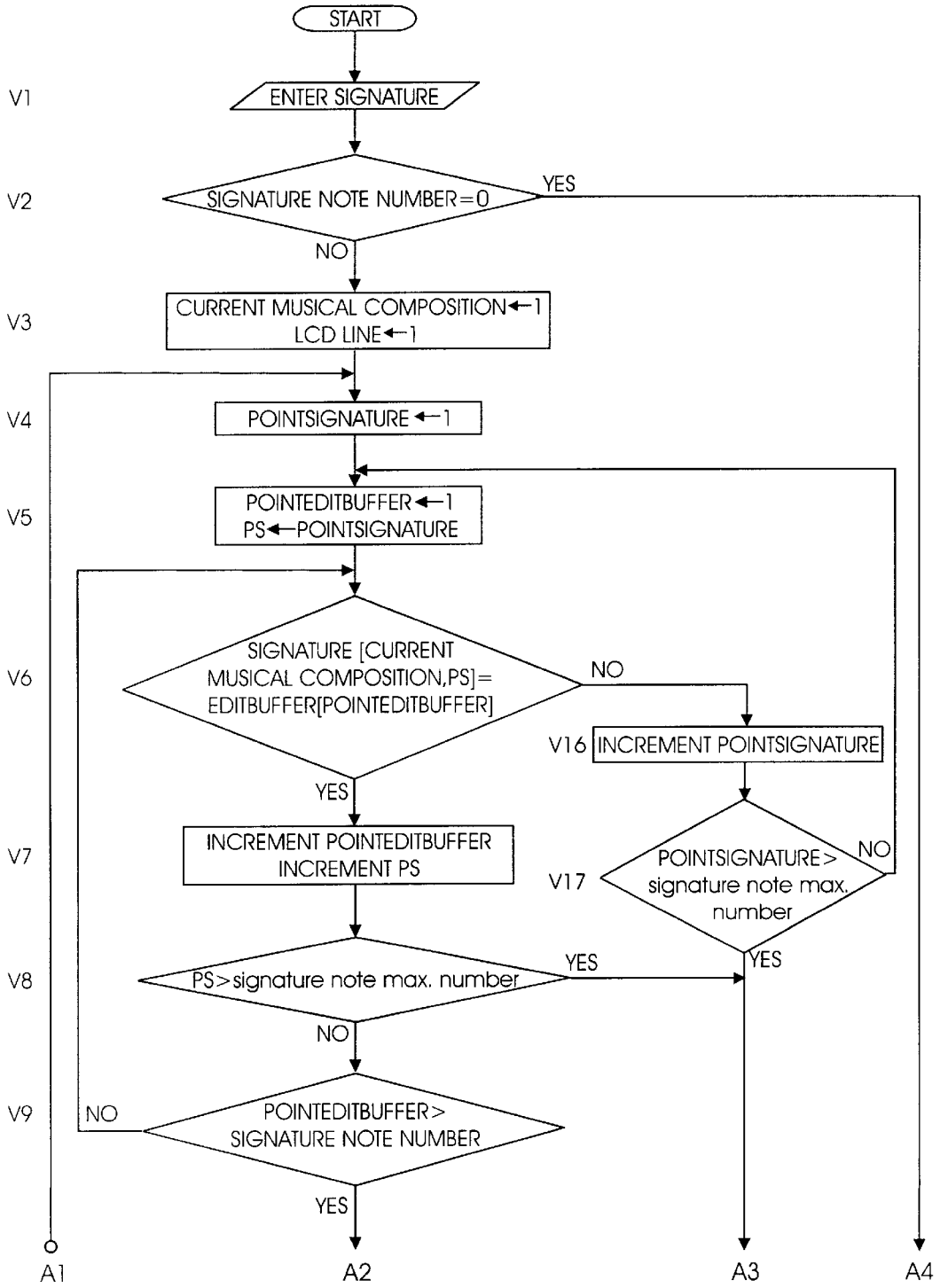
Figure 6:
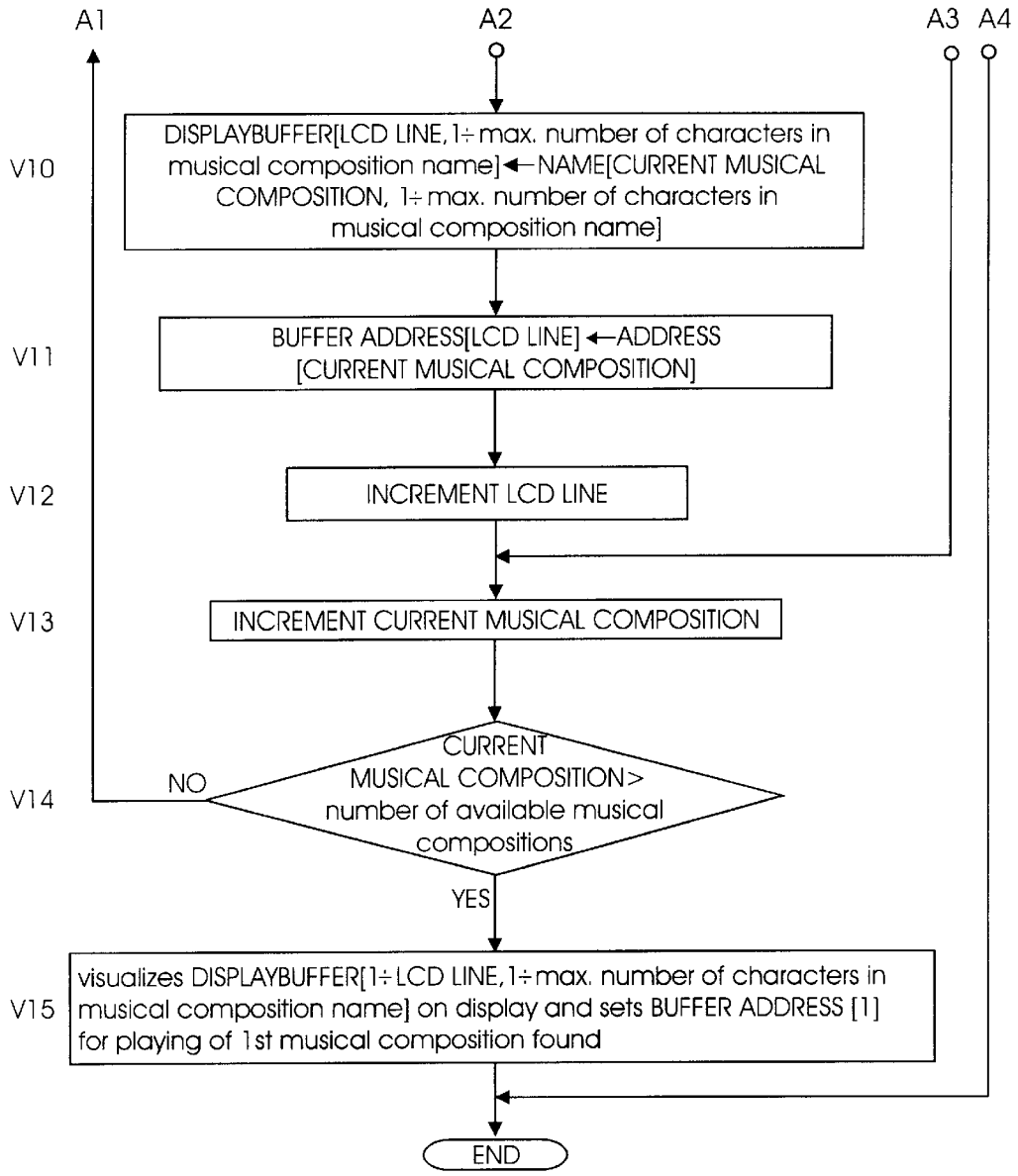
Figure 7:
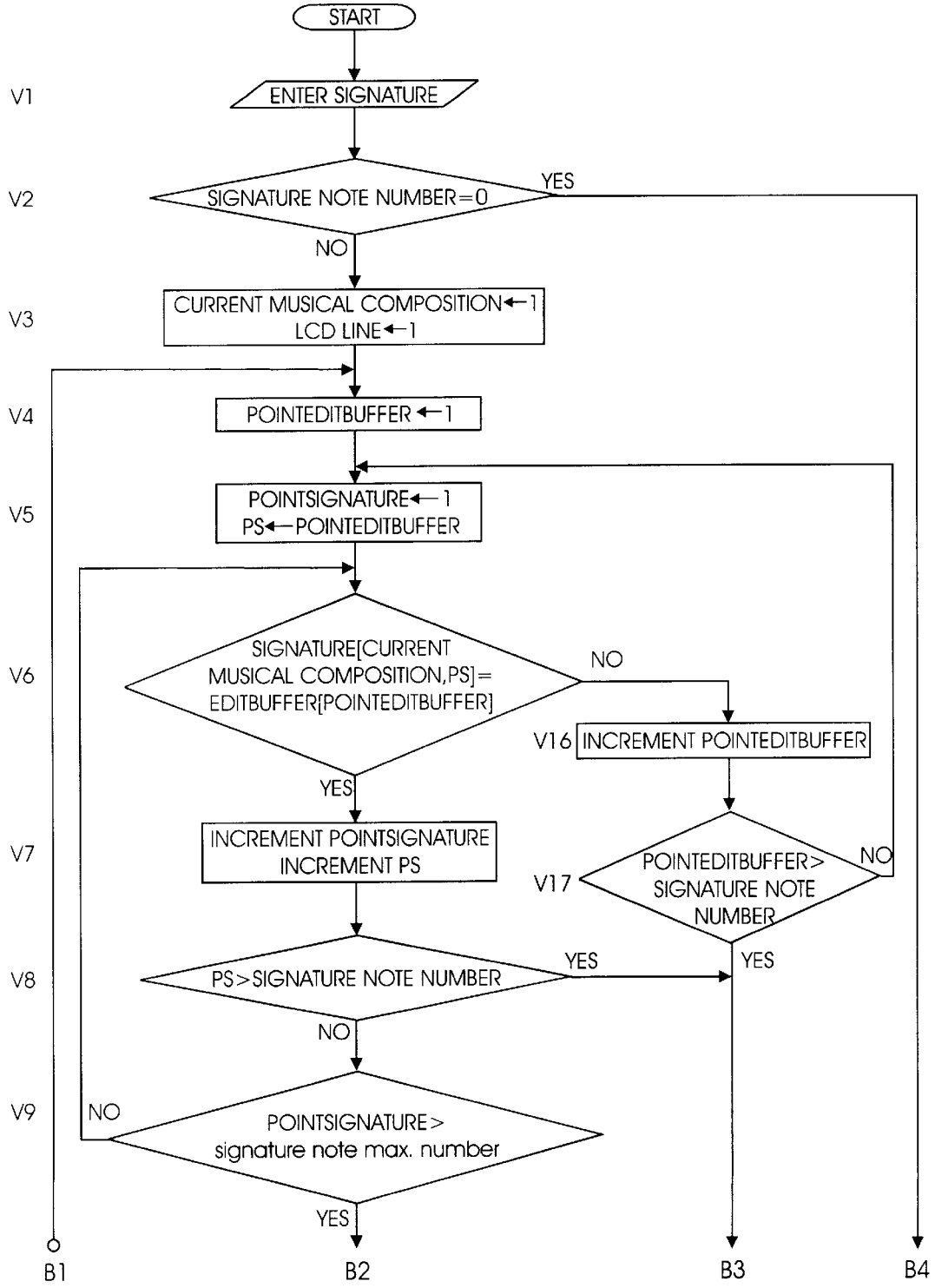
Figure 8:
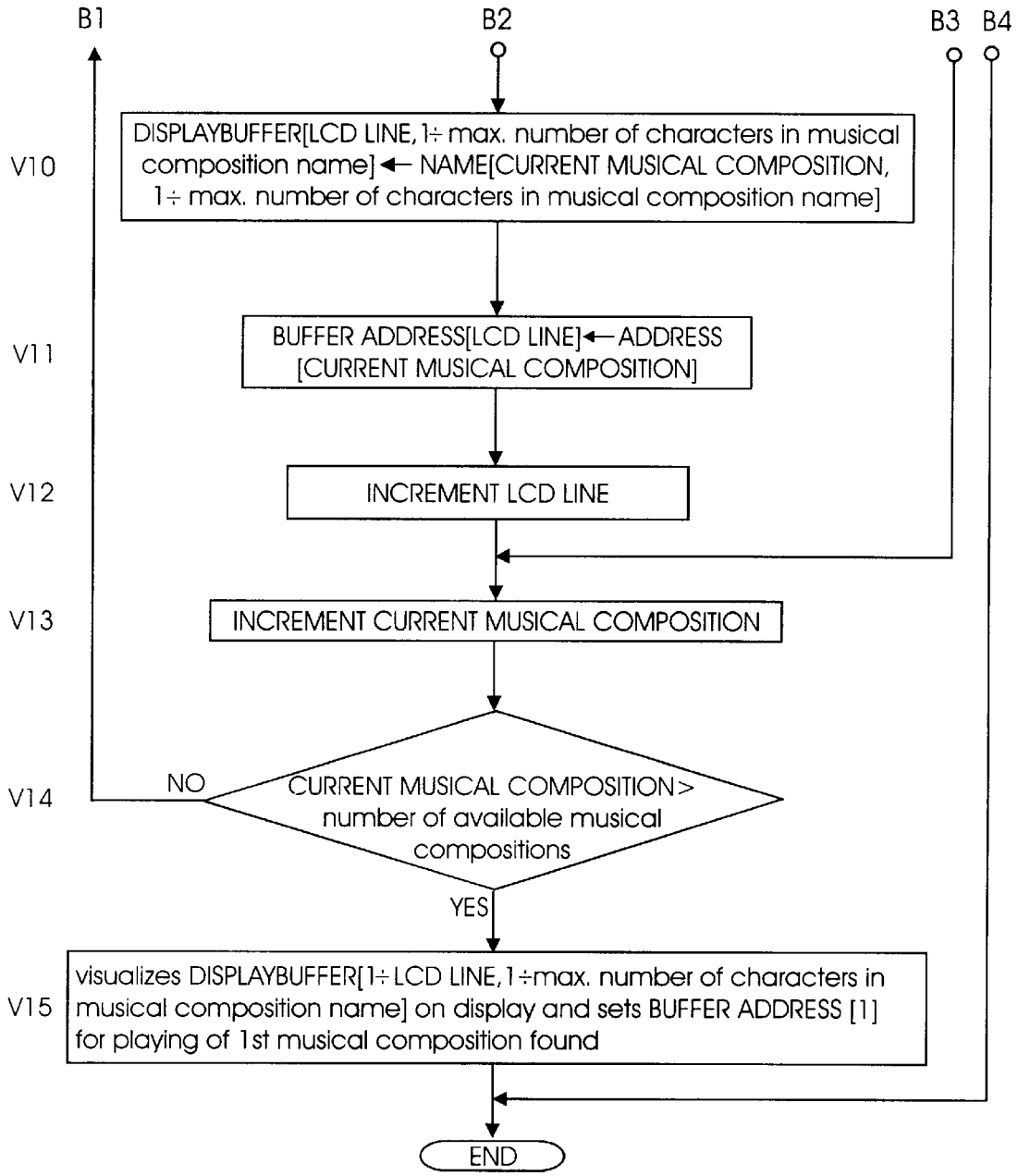
Figure 9:
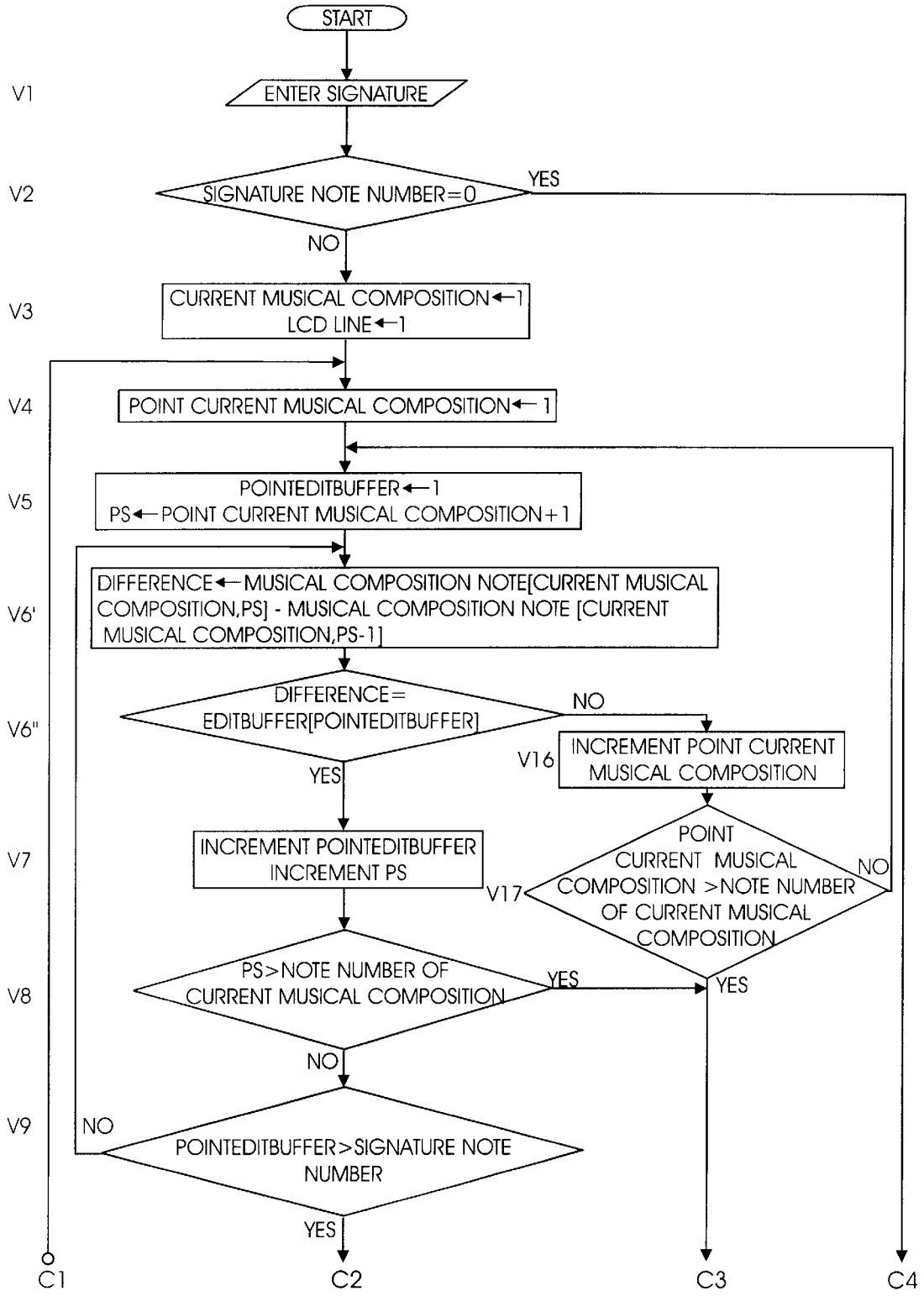
FIGS. 9 and 10 show in combination a flow chart illustrating the automatic search for a sequence of musical events, directly within a musical composition.

The steps U1 to U9 in FIG. 4 have been summarized as the step S1 in FIG. 3 and V1 in FIGS. 5, 7 and 9 since the same steps will be used in the subsequent search for a musical composition, shown in the flow charts according to FIGS. 5 and 6, 7 and 8, 9 and 10.

At this point, by actuating an appropriate control switch on the panel 11, the signature thus assigned is stored in the mass memory 4; this operation consists in recording the RAM memory locations containing the differences, so as to correspond to the selected musical composition (step S2—SIGNATURE[CURRENT MUSICAL COMPOSITION, 1÷SIGNATURE NOTE NUMBER]← EDITBUFFER[1÷SIGNATURE NOTE NUMBER] and step S3—stores in mass memory SIGNATURE[CURRENT MUSICAL COMPOSITION, 1÷SIGNATURE NOTE NUMBER] and SIGNATURE NOTE NUMBER]). In addition to the differences, the number of musical note events forming the signature, to be used in a subsequent search step (steps S2 and S3), is also recorded in the RAM memory.

AUTOMATIC SEARCHING FOR THE COMPOSITIONS

With reference now to FIGS. 5 and 6 which in combination show a single flow chart, the procedures for automatically searching for a musical composition from a plurality of musical compositions stored in the mass memory 4, by the musical search technique according to the present invention, will now be described; for the time being we shall consider only the case in which the number of notes or events of the sequence entered is less than or equal to the allowed maximum number of notes or musical events related to the various musical compositions and pre-stored in the mass memory 4.

The same control means used to assign and enter the various identification signatures, for example the musical keyboard 7 or other suitable control means connected via the MIDI port or interface 10, are used to enter again the same sequences of connoting musical events, in particular the same sequences of musical notes which make up a signature, or a significant part thereof, hereinbelow called search sequences of musical events, for finding one or more musical compositions stored in the mass memory 4.

The CPU, depending on its working program and the classification and search algorithms memorized therein, read-out from the mass memory 4 that musical composition or those musical compositions whose sequences of pre-stored musical notes, forming the connoting signature, are entirely or partly the same as the search sequence of musical notes which have just been entered.

Since according to this preferred embodiment, the musical notes forming the connoting signature are not stored as an absolute value, but as a relative difference, the search is therefore independent of the musical key of the signature itself as well as the rhythm.

This constitutes a considerable advantage for the player since he therefore does not have to remember the key or the rhythm of the stored connoting signature, even after a considerable amount of time has lapsed. The musical compositions are therefore read-out and the data is thus written or shown on the display 13 for example in the form of the identifying name, and the first of these compositions is set so that it can be listened to again via blocks 16 and 17 or via the MIDI port 10.

More in particular, at the start of the searching procedure for a musical composition, after actuation of the start switch on the appropriate control panel 11, the CPU performs step V1 (FIG. 5—ENTER SIGNATURE) formed by the steps U1–U9 of the preceding flow chart in FIG. 4 and already described with regard to entry of the musical note events forming the connoting signature.

After entry of the connoting signature in order to search for the desired musical composition (step V1) and if said signature is not empty (step V2—SIGNATURE NOTE NUMBER=0), the first musical composition is selected and the RAM memory is set for storage of the names and addresses of the musical compositions read-out in the first position (step V3—CURRENT MUSICAL COMPOSITION←1, LCDLINE←1), and the first position of the differences between musical note events forming the connoting signature of the musical composition currently selected in the mass memory, is selected (step V4—POINTSIGNATURE←1).

The CPU, performing the preset search program, then proceeds to select the first position of the difference between musical notes or events forming the signature just entered and hence to be searched for among the plurality of musical compositions existing in the mass memory (step V5—POINTEDITBUFFER←1).

Since the number of musical notes entered for the signature to be searched for, forming the search sequence, may be equal to or less than the number of notes of the connoting signature pre-stored in the mass memory for a certain musical composition, the CPU initializes another RAM memory location (PS) indicating from which position in the signature of the currently selected musical composition the comparison must be started (step V5—PS←POINTSIGNATURE).

If the comparison has a negative outcome (step V6—SIGNATURE[CURRENT MUSICAL COMPOSITION,PS]=EDITBUFFER [POINTEDITBUTTFER]), the CPU selects the next position in the signature of the currently selected musical composition (step V16—INCREMENT POINTSIGNATURE) and if the maximum allowed number is not exceeded (step V17—POINTSIGNATURE>signature note maximum number) it continues comparing in each case the difference between the musical notes contained therein with the contents of the first position of the signature just entered and therefore to be searched for (steps V17, V5 and V6).

Therefore, if it reaches the last position in the signature of the musical composition currently selected in the mass memory, without finding any equivalence with the signature just entered and hence relating to the composition to be searched for (step V17—POINTSIGNATURE>signature note maximum number) the CPU passes to the next musical composition available in the mass memory (steps V13, V14, V4), i.e. it passes from the step V17 to the step V13 and from here to the step V14 and returns again to the step V4 relating to the signature of the next musical step.

If, on the other hand, the comparison has a positive outcome (step V6), the CPU compares one by one the successive positions of the signature of the musical composition currently selected in the mass memory (SIGNATURE [CURRENT MUSICAL COMPOSITION, PS]) with that of the musical composition just entered and therefore to be searched for (EDITBUFFER [POINTEDITBUFFER]) (step V7—INCREMENT POINTEDITBUFFER, INCREMENT PS).

If the last position allowed in the signature of the currently selected musical composition is reached without finding any equivalence with the signature just entered and hence to be searched for (step V8—PS>signature note maximum number), the CPU passes to the next musical composition available in the mass memory, proceeding with step V13 (and steps V14, V4).

If, on the other hand, it reaches a number of comparisons with a positive outcome, equal to the number of note events forming the signature just entered and hence to be searched for (step V9—POINTEDITBUFFER>SIGNATURE NOTE NUMBER), this means that the musical composition currently selected in the mass memory has a signature corresponding to that just entered for the composition to be searched for.

The CPU then temporarily stores the names and/or the connoting data of the musical composition selected in the RAM 3 of FIG. 3, while waiting for display on the block 11 (step V10—DISPLAYBUFFER[LCDLINE, 1÷maximum number of characters in musical composition name]←NAME [CURRENT MUSICAL COMPOSITION, 1÷maximum number of characters in musical composition name]), which will occur when all the musical compositions existing in the mass memory have been scanned (step V14—CURRENT MUSICAL COMPOSITION>number of available musical compositions and step V15—visualizes DISPLAYBUFFER [1÷LCDLINE,1÷maximum number of characters in musical composition name] on display and sets BUFFERADDRESS [1] for playing the 1st musical composition found).

The address of the musical data of the current musical composition is also temporarily stored such that it may be played again, if necessary, by the musician who has musically selected it in the manner described above (step V11—BUFFERADDRESS [LCDLINE]←ADDRESS [CURRENT MUSICAL COMPOSITION]).

The CPU also sets the RAM 3 intended to contain the names and addresses of the musical compositions read-out from the plurality of compositions available in the mass memory 4, for a possible new reading-out produced by the search in progress (step V12—INCREMENT LCDLINE). The procedure continues, passing to the next musical composition available in the mass memory until all the associated musical compositions have been scanned (step V14 and hence V4).

When all the musical compositions existing in the mass memory have been scanned and it has read-out those compositions which can be related to the signature or search note sequence, the CPU, as already mentioned, displays the names or the specific data of musical compositions read-out, setting the first one so that it can be played again if necessary (step V15), this step being activated by a special switch on the control panel 11, allowing the operator the possibility to select and perform again any other musical composition from those which have been previously read-out.

SEARCHING WITH A SEQUENCE OF EVENTS GREATER THAN THE MAXIMUM ALLOWED NUMBER

With reference to the flow chart shown in FIGS. 7 and 8, we shall now describe the automatic searching for musical compositions from a plurality of compositions contained in the mass memory, in the case where the number of musical notes, or more generally musical events of the search sequence entered, is greater than the allowed maximum number of notes or musical events related to the various musical compositions pre-stored in the mass memory and forming the connoting signatures.

As it can be seen from FIGS. 7 and 8, compared to the preceding flow chart shown in FIGS. 5 and 6, the steps V4, V5, V6, V7, V8, V9, V16 and V17 now change because the role of the sequence of musical notes entered for the search is reversed with respect to that of the sequence of connoting notes related to the various musical compositions and pre-stored in the mass memory (reversion of role between POINTSIGNATURE and POINTEDITBUFFER).

Basically, while the flow chart in FIGS. 5 and 6 describes the search for the sequence of musical notes entered by the operator, within the sequences of connoting musical notes related to the various musical compositions pre-stored in the mass memory, the flow chart in FIGS. 7 and 8 describes, on the other hand, the search for the sequences of connoting musical notes related to the various musical compositions and pre-stored in the mass memory, within the search sequence consisting of the musical notes or the musical events entered by the operator.

More particularly, at the start of the searching procedure for a musical composition, after the actuation of the start switch on the appropriate control panel 11, the CPU performs the step V1 (FIG. 5—ENTER SIGNATURE) consisting of the steps U1–U9 of the preceding flow chart according to FIG. 4 and already described in connection with entry of the musical note events forming the connoting signature.

After entry of the connoting signature for searching for the desired musical composition (step V1) A and if said signature is not empty (step V2—SIGNATURE NOTE NUMBER=0), the first musical composition is selected and the RAM set for storage of the names and addresses of the musical compositions read-out in the first position (step V3—CURRENT MUSICAL COMPOSITION←1, LCDLINE←1), and the first position of the differences between notes or musical events forming the signature just entered and therefore to be searched for among the plurality of musical compositions existing in the mass memory is selected (step V4—POINTEDITBUFFER←1).

The CPU, performing the preset search program, then proceeds to select the first position of the differences between notes or musical events forming the identification signature of the musical composition currently selected in the mass memory (step V5—POINTSIGNATURE←1).

Since the number of musical notes entered in connection with the signature to be searched for, forming the search sequence, is greater than the number of notes of the connoting signature pre-stored in the mass memory for a certain musical composition, the CPU initializes another RAM memory location (PS) indicating from which position in the signature just entered it is required to start the comparison (step V5—PS←POINTEDITBUFFER).

If the comparison has a negative outcome (step V6—SIGNATURE[CURRENT MUSICAL COMPOSITION,PS]=EDITBUFFER [POINTEDITBUFFER]), the CPU selects the next position in the signature just entered (step V16—INCREMENT POINTEDITBUFFER) and if the maximum number of differences just entered is not exceeded (step V17—POINTEDITBUFFER>SIGNATURE NOTE NUMBER) the CPU continues to compare in each case the difference between the musical notes contained therein with the contents of the first position of the connoting signature of the musical composition currently selected in the mass memory (steps V17, V5 and V6).

Therefore, if the last position in the signature just entered and hence relating to the composition to be searched for is reached, without finding any equivalence with the signature of the musical composition currently selected in the mass memory (step V17—POINTEDITBUFFER>SIGNATURE NOTE NUMBER), the CPU passes to the next musical composition available in the mass memory (steps V13, V14, V4).

If, on the other hand, the comparison has a positive outcome (step V6), the CPU proceeds to compare one by one the successive positions of the signature of the musical composition currently selected in the mass memory (SIGNATURE[CURRENT MUSICAL COMPOSITION, PS]) with that of the musical composition just entered and hence to be searched for (EDITBUFFER [POINTEDITBUFFER]) (step V7—INCREMENT POINTSIGNATURE, INCREMENT PS).

If the last position allowed in the signature just entered and hence to be searched for is reached, without finding any equivalence with the signature of the musical composition currently selected in the mass memory (step V8—PS>SIGNATURE NOTE NUMBER) the CPU passes to the next musical composition available in the mass memory, proceeding with the step V13 (and steps V14, V4).

If, on the other hand, a number of comparisons with a positive outcome, equivalent to the number of differences between note events forming the signature currently selected in the mass memory, is reached (step V9—POINTSIGNATURE>signature note maximum number), this means that the musical composition currently selected in the mass memory has a signature corresponding to that just entered for the composition to be searched for.

The CPU then proceeds to store temporarily the name and/or connoting data of the selected musical composition in the RAM 3 of FIG. 1, while waiting for display on the block 11 (step V40—DISPLAYBUFFER[LCDLINE, 1÷maximum number of characters in musical composition name]←NAME [CURRENT MUSICAL COMPOSITION, 1÷maximum number characters in musical composition name]), which will occur when all the musical compositions existing in the mass memory have been scanned (step V14—CURRENT MUSICAL COMPOSITION>number of available musical compositions and step V15—visualizes DISPLAYBUFFER[1÷LCDLINE,1÷maximum number of characters in musical composition names] on display and sets BUFFERADDRESS[1] for playing the 1st musical composition found).

The address of the musical data of the current musical composition is also stored, setting it such that it may be played again, if necessary, by the musician who has musically selected it in the manner described above (step V11—BUFFERADDRESS [LCDLINE←ADDRESS [CURRENT MUSICAL COMPOSITION]).

The CPU also sets the RAM 3 intended to contain the names and the addresses of the musical compositions read-out from the plurality of compositions available in the mass memory 4, for a possible future reading-out produced by the search in progress (step V12—INCREMENT LCDLINE). The procedure continues passing to the next musical composition available in the mass memory until all the associated musical compositions (step V14 and hence V4) have been scanned.

When all the musical compositions existing in the mass memory have been scanned and it has read-out those which can be related to the signature or search note sequence, the CPU visualizes the names or the specific data of musical compositions read-out, setting the first one so that it can be played again if necessary (step V15), this step being activated by a special switch on the control panel 11, allowing the operator the possibility to select and perform again any other musical composition from those selected and read-out.

Therefore, for illustration of the flow chart according to FIGS. 7 and 8, reference should be made to that previously stated for the flow chart according to FIGS. 5 and 6, taking into account the aforementioned step changes, whereby it must be pointed out that what has been illustrated and shown in FIGS. 7 and 8 forms an integral part of the present description.

SEARCH WITHIN THE MUSICAL COMPOSITION

Figure 10:
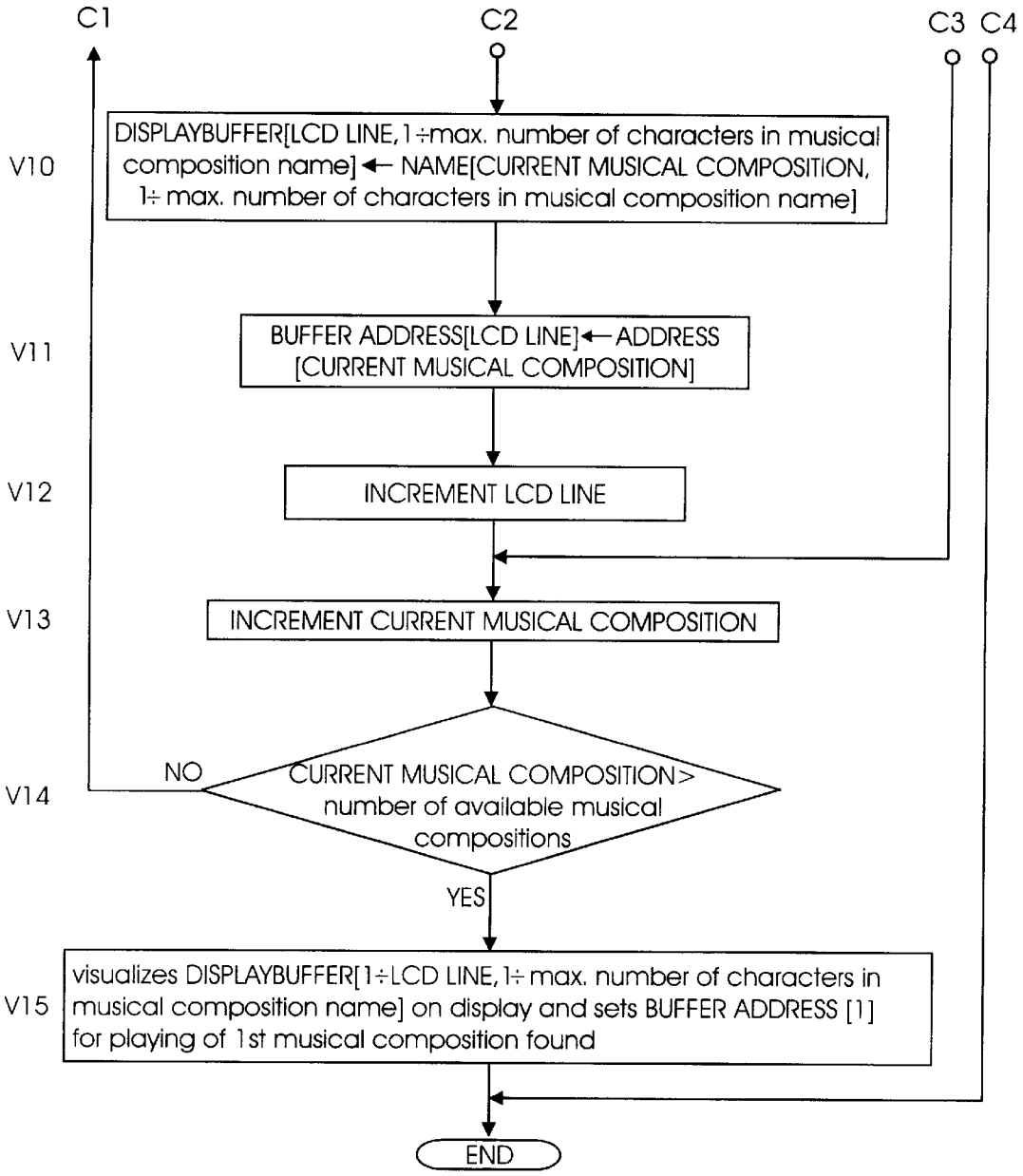

With reference lastly to the flow chart according to FIGS. 9 and 10, the automatic search for musical compositions from a plurality of musical compositions contained in the mass memory, in the case where no connoting signature for each musical composition has been pre-stored, will be briefly described. Since the connoting signature no longer exists, the steps S2 and S3 of FIG. 3 disappear, so that only the step S1 remains.

The search, which in the previous examples according to FIGS. 5, 6, 7 and 8 was limited to only the connoting signature, is now extended within the whole of the musical composition, applying the same rules.

Basically, in FIGS. 9 and 10, the connoting signature and its position indicator (SIGNATURE and POINT SIGNATURE) are replaced respectively by the notes of whole musical composition and by its position indicator (MUSICAL COMPOSITION NOTE and POINT CURRENT MUSICAL COMPOSITION).

Moreover, for reasons of a practical nature, the step V6 has been split into the steps V6' and V6", although the logic flow remains unchanged.

More particularly, at the start of the searching procedure for a musical composition, after the actuation of the start switch on the appropriate control panel 11, the CPU performs the step V1 (FIG. 9—ENTER SIGNATURE) consisting of the steps U1–U9 of the preceding flow chart according to FIG. 4 and already described in connection with the entry of the musical note events forming the connoting signature.

After entry of the connoting signature for searching for the desired musical composition (step V1) and if said signature is not empty (step V2—SIGNATURE NOTE NUMBER=0), the first musical composition is selected and RAM set for storage of the names and addresses of the musical compositions read-out in the first position (step V3—CURRENT MUSICAL COMPOSITION←1, LCDLINE←1), and the first position (first Note ON musical event) of the musical composition currently selected in the mass memory (step V4—POINT CURRENT MUSICAL COMPOSITION←1).

The CPU, performing the preset search program, then proceeds to select the first position of the difference between notes or musical events forming the signature just entered and hence to be searched for among the plurality of musical compositions existing in the mass memory (step V5—POINTEDITBUFFER←1).

Since the number of musical notes entered in relation to the signature to be searched for, forming the search sequence, may be equal to or less than the number of notes of the musical composition existing in the mass memory, the CPU initializes another RAM memory location (PS) indicating from which position in the musical composition itself, currently selected, it is required to start the comparison (step V5≠PS←POINT CURRENT MUSICAL COMPOSITION+1).

Since the musical composition contains the musical note events as an absolute value, it is necessary to calculate the difference between the pitches of the musical notes (step V6'—DIFFERENCE←MUSICAL COMPOSITION NOTE [CURRENT MUSICAL COMPOSITION,PS]–MUSICAL COMPOSITION NOTE[CURRENT MUSICAL COMPOSITION,PS–1]) so as to be able to perform the comparison thereof with the musical notes entered for the signature to be searched for (step V6") and stored in the form of a difference, as already described.

This difference (step V6') is calculated, as always, by subtracting from the pitch of the note of the musical composition (MUSICAL COMPOSITION NOTE) currently selected (indicated by PS), the pitch of the note of the preceding musical composition (MUSICAL COMPOSITION NOTE) (indicated by PS-1).

If the comparison has a negative outcome (step V6"—DIFFERENCE=EDITBUFFER [POINTEDITBUFFER]), the CPU selects the next position (the next musical note event) in the musical composition currently selected (step V16—INCREMENT POINT CURRENT MUSICAL COMPOSITION) and if the maximum number of musical note events contained therein is not exceeded (step V17—POINT CURRENT MUSICAL COMPOSITION>NOTE NUMBER OF CURRENT MUSICAL COMPOSITION) the CPU continues, calculating the difference between the musical notes contained therein (step V6') and comparing each time this difference (step V6") with the contents of the first position of the signature just entered and hence to be searched for (EDIT BUFFER) (steps V17, V5, V6' and V6").

Therefore, if the last position in the musical composition currently selected in the mass memory is reached, without finding any equivalence with the signature just entered and hence relating to the composition to be searched for (step V17—POINT CURRENT MUSICAL COMPOSITION>NOTE NUMBER IN CURRENT MUSICAL COMPOSITION), the CPU passes to the next musical composition available in the mass memory (steps V13, V14, V4).

If, on the other hand, the comparison has a positive outcome (step V6"), the CPU proceeds to compare one by one the successive positions of the musical composition currently selected in the mass memory (MUSICAL COMPOSITION NOTES[CURRENT MUSICAL COMPOSITION,PS] and compare it with that of the musical composition just entered and hence to be searched for (EDITBUFFER[POINTEDITBUFFER]) (step V7—INCREMENT POINTEDITBUFFER, INCREMENT PS).

If the last position allowed in the musical composition currently selected is reached, without finding any equivalence with that just entered and hence to be searched for (step V8—PS>NOTE NUMBER OF CURRENT MUSICAL COMPOSITION) the CPU passes to the next musical composition available in the mass memory, prosecuting with the step V13 (and steps V14, V4).

If, on the other hand, a number of comparisons with a positive outcome, equivalent to the number of note events forming the signature just entered and hence to be searched for, is reached (step V9—POINTEDITBUFFER>SIGNATURE NOTE NUMBER), this means that the musical composition currently selected in the mass memory has a signature corresponding to that just entered for the composition to be searched for.

The CPU then proceeds to store temporarily the name and/or the connoting data of the selected musical composition in the RAM 3 of FIG. 1, while waiting for display on the block 11 (step V10—DISPLAYBUFFER[LCDLINE, 1 maximum number of characters in musical composition name]←NAME [CURRENT MUSICAL COMPOSITION, 1÷maximum number of characters in musical composition name]), which will occur when all the musical compositions existing in the mass memory have been scanned (step V14—CURRENT MUSICAL COMPOSITION>number of available musical compositions and step V15—visualizes DISPLAYBUFFER[1LCDLINE,1÷maximum number of characters in musical composition name] on display and sets BUFFERADDRESS[1] for playing the 1st musical composition found).

The address of the musical data of the current musical composition is also stored, setting it such that it may be played again by the musician who has musically selected it in the manner described above (step V11—BUFFERADDRESS [LCDLINE]←ADDRESS [CURRENT MUSICAL COMPOSITION]).

The CPU also sets the RAM 3 intended to contain the names and the addresses of the musical compositions read-out from the plurality of compositions available in the mass memory 4, for a possible future reading-out produced by the search in progress (step V12—INCREMENT LCDLINE). The procedure continues passing to the next musical composition available in the mass memory until all the associated musical compositions have been scanned (step V14 and hence V4).

When all the musical compositions existing in the mass memory have been scanned and it has read-out those which can be related to the signature or search note sequence, the CPU displays the names or the specific data of musical compositions read-out, setting the first one so that it can be played again if necessary (step V15), this step being activated by a special switch on the control panel 11, allowing the operator the possibility to select and perform again any other musical composition from those read-out.

From what has been said and illustrated with reference to the accompanying drawings, it will therefore be understood that it has been possible to provide a method and an electronic apparatus for classifying and automatically searching for musical compositions in an electronic library, by means of a musical connoting and search technique which is particularly suited to the musical background of the musician and also allows extremely rapid searching within musical libraries containing a considerable number of compositions; although the invention is applicable preferably to the case where the musical connoting events are formed by ON/OFF Note events with coded data relating to the differences in pitch between the notes both of the pre-stored composition connoting sequence and the search sequence entered by an operator, as explained above, or by other musical events and data relating to the compositions existing in the mass memory, it is understood that the application of the invention may also be extended to those cases where the musical connoting and search events of the various compositions are different from the musical notes related to the composition or compositions to be searched for and, for example, are formed by percussion events or drum phrases of the accompaniment part of a composition, or may be formed by musical events which are not related to the said compositions, for example note events or other types of musical events which have been specially generated and stored by an operator.

What we claim is:

1. A method for reading a requested musical composition from among a plurality of musical compositions using an electronic musical instrument that has a memory storing the plurality of musical compositions, the method comprising the steps of:

defining for each of the stored musical compositions an identifying sequence of musical note events which uniquely identifies the musical composition, the musical note events being at least one of a plurality of musical notes, differences in pitch between adjacent musical notes in a series of musical notes, and a beat;

storing the identifying sequences in the memory and associating in the memory each of the stored identifying sequences with the corresponding one of the plurality of musical compositions;

musically performing on the electronic musical instrument a search sequence of the musical note events which corresponds to at least a recognizable portion of one of the identifying sequences;

locating a particular one of the identifying sequences which corresponds to the performed search sequence by comparing the performed search sequence to the identifying sequences stored in the memory; and reading from the memory the musical composition which is uniquely identified by the particular one of the identifying sequences.

2. The method of claim 1, wherein each of the identifying sequences comprises a sequence of the musical note events from one of a melodic part, an accompanying part and a beat of the musical composition uniquely identified by the identifying sequence.

3. The method of claim 1, wherein at least one of the identifying sequences comprises a sequence of percussion sounds from the musical composition uniquely identified by the at least one identifying sequence.

4. The method of claim 1, wherein at least one of the identifying sequences comprises a sequence of the musical note events that is not found in the musical composition uniquely identified by the at least one identifying sequence.

5. The method of claim 1, further comprising the step of displaying at least one of a title and an author of the musical composition which is uniquely identified by the particular one of the identifying sequences.

6. A system for storing and reading a plurality of musical compositions, comprising:

a memory storing a plurality of musical compositions and a plurality of identifying sequences of musical note events which each uniquely identifies a particular one of the stored musical compositions, the musical note events being at least one of a plurality of musical notes, differences in pitch between adjacent musical notes in a series of musical notes, and a beat;

an instrument connected to said memory that provides a search sequence of the musical note events which corresponds to at least a recognizable portion of one of the identifying sequences;

a first set of instructions in readable form that is connected to said memory and to said instrument and that is arranged and adapted to locate a particular one of the identifying sequences which corresponds to the provided search sequence by comparing the provided search sequence to the identifying sequences stored in said memory; and a second set of instructions in readable form that is arranged and adapted to read from said memory the musical composition which is uniquely identified by the particular one of the identifying sequences.

7. The system of claim 6, wherein said instrument is a musical instrument, and wherein said memory and said player are contained within said musical instrument.

8. The system of claim 6, wherein said instrument is a musical instrument, and wherein said memory is outside said musical instrument.

9. The system of claim 6, wherein said instrument is a musical keyboard.

10. The system of claim 6, wherein said instrument comprises a MIDI port.

11. An electronic apparatus for storing, classifying and automatically searching musical compositions, comprising:

a data control and process unit;

first memory means for storing a plurality of musical compositions in data form;

musical event generating means operatively connected to data inlets of said data control and process unit, for generating in data form connoting sequences of musical events that each uniquely identify one of said musical compositions stored in said first memory means;

second memory means for storing the connoting sequences of musical events identifying said musical compositions stored in said first memory means;

assigning means for assigning each of the connoting sequence of musical events to a corresponding one of said plurality of stored musical compositions;

said musical event generating means further providing a musically performed search sequence of musical events related to one of the connoting sequences of musical events of a requested one of the musical compositions stored in said first memory means;

said data control and process unit embodying a set of instructions in readable form for classifying each of the stored musical compositions by assigning a corresponding one of the connoting sequences of musical events provided by said musical event generating means;

said data control and process unit further embodying a set of instructions in readable form for automatically searching a requested musical composition by comparing the data of the search sequence of musical events provided by said musical events generating means, with the data of the connoting sequences of the classified musical compositions stored in said first memory means; and program means in said control and process unit for reading-out the requested musical composition from said plurality of classified musical compositions related to the connoting sequence of musical events stored in said second memory means that corresponds to the search sequence of musical events generated by said musical events generating means.

12. The instrument of claim 11, wherein said musical events are at least one of a plurality of musical notes, differences in pitch between adjacent musical notes in a series of-musical notes, and a beat.

13. Electronic apparatus according to claim 11, wherein said musical event generating means comprises a control keyboard.

14. Electronic apparatus according to claim 13, wherein said control keyboard is a musical keyboard.

15. Apparatus according to claim 11, wherein said musical event generating means comprises a MIDI port.

16. Apparatus according to claim 11, wherein said first memory means comprises a mass memory contained inside the apparatus.

17. Apparatus according to claim 11, wherein said first memory means comprises a mass memory provided outside said musical event generating means.

18. A method for reading out a requested musical composition from a plurality of musical compositions, by an electronic musical instrument, comprising the steps of:

storing in data form a plurality of musical compositions in a first memory for the electronic musical instrument;

defining for each of the stored musical compositions, a connoting sequence of musical events which uniquely identifies the musical composition;

storing in data form in a second memory for the musical instrument, each of the connoting sequences of musical events corresponding to each of the stored musical compositions;

classifying the plurality of stored musical compositions by assigning into a programmed data process and control unit, a connoting sequence of musical events to each of the stored musical compositions;

musically performing a search sequence of plural musical events corresponding to at least a significant part of one of the connoting sequences of musical events corresponding to a requested one of the stored musical compositions and providing the performed search sequence to the process and control unit in data form;

searching, by means of the programmed process and control unit, the requested musical composition by comparing the data for the musically performed search sequence with the data for the connoting sequences of musical compositions stored in the first memory means; and reading-out from the stored plurality of musical compositions, the requested musical composition related to the connoting sequence of musical events corresponding to the musically performed search sequence of musical events.

19. The method of claim 18, wherein the musical events are at least one of a plurality of musical notes, differences in pitch between adjacent musical notes in a series of musical notes, and a beat.

20. Method according to claim 18, wherein said sequence of connoting musical events comprises a sequence of musical events belonging to the classified musical composition.

21. Method according to claim 20 wherein said sequence of connoting musical events comprises a plurality of note musical events relating to at least one of the melodic part, accompaniment part, beat of the uniquely identified musical composition.

22. Method according to claim 20, wherein said sequence of connoting musical events comprises a sequence of percussion sounds.

23. Method according to claim 18, wherein said sequence of connoting musical events comprises musical events not forming part of the stored musical composition.

24. Method according to claim 18, wherein the data relating to each stored musical composition comprises data selected from the actual musical structure of the composition.

25. Method according to claim 18, wherein the stored data of each sequence of connoting musical events comprises the differences in pitch between musical note events contained in each stored musical composition.

26. Method according to claim 18, wherein said connoting musical events of the compositions comprise the difference in pitch between one note event and the immediately preceding one.

27. Method according to claim 20, wherein said connoting musical events of the compositions comprises events related to the beat of each musical composition.

28. Method according to claim 18, wherein at the same time as the search for and selection of a musical composition from among said plurality of stored musical compositions, data relating to the selected musical composition are displayed.

* * * * *